US008285170B2

(12) United States Patent
Okuda

(10) Patent No.: US 8,285,170 B2
(45) Date of Patent: Oct. 9, 2012

(54) IMAGE HEATING APPARATUS AND IMAGE FORMING APPARATUS WITH CURL CORRECTING MECHANISM

(75) Inventor: Kazuhisa Okuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 12/682,862

(22) PCT Filed: Oct. 1, 2008

(86) PCT No.: PCT/JP2008/068252

§ 371 (c)(1),
(2), (4) Date: Apr. 13, 2010

(87) PCT Pub. No.: WO2009/051040

PCT Pub. Date: Apr. 23, 2009

(65) Prior Publication Data

US 2010/0226681 A1 Sep. 9, 2010

(30) Foreign Application Priority Data

Oct. 17, 2007 (JP) ..... 2007-270084

(51) Int. Cl.
*G03G 21/20* (2006.01)

(52) U.S. Cl. ..... 399/92; 399/122; 399/329; 399/331

(58) Field of Classification Search ..... 399/92, 399/122, 329, 331

See application file for complete search history.

(56) References Cited

U.S. PATENT DOCUMENTS

| | | | | |
|---|---|---|---|---|
| 7,184,698 | B2 * | 2/2007 | Tombs | 399/341 |
| 2004/0091295 | A1 * | 5/2004 | Nakamura et al. | 399/327 |
| 2005/0008408 | A1 * | 1/2005 | Inomata | 399/323 |

FOREIGN PATENT DOCUMENTS

| | | | |
|---|---|---|---|
| JP | 04-199172 | A | 7/1992 |
| JP | 04-216580 | A | 8/1992 |
| JP | 05-72926 | A | 3/1993 |
| JP | 05-341600 | A | 12/1993 |
| JP | 06-156852 | A | 6/1994 |
| JP | 07-219366 | A | 8/1995 |
| JP | 11-305591 | A | 11/1999 |
| JP | 2001-331043 | A | 11/2001 |
| JP | 2002-099168 | A | 4/2002 |
| JP | 2002-099168 | A | 4/2002 |
| JP | 2002-268417 | A | 9/2002 |
| JP | 2002-316761 | A | 10/2002 |
| JP | 2003-280439 | A | 10/2003 |
| JP | 2004-203527 | A | 7/2004 |

* cited by examiner

*Primary Examiner* — Ryan Walsh

(74) *Attorney, Agent, or Firm* — Canon USA, Inc., IP Division

(57) ABSTRACT

An image heating apparatus includes a rotatable belt to be heated, a pressure roller for pressure-contacting the rotatable belt so as to constitute a pressure contact portion in which a recording sheet is nipped and conveyed so that an image on the recording sheet is heated, and a roller provided for pressing an outer circumferential surface of the rotatable belt inward on a downstream in a sheet conveying direction of the pressure contact portion.

12 Claims, 11 Drawing Sheets

IMAGE HEATING APPARATUS AND IMAGE FORMING APPARATUS WITH CURL CORRECTING MECHANISM

CROSS REFERENCE TO RELATED APPLICATIONS

This application is a National Stage filing of PCT application No. PCT/JP2008/068252 filed on Oct. 1, 2008, which claims priority from Japanese Patent Application No. 2007-270084 filed on Oct. 17, 2007, the disclosures of which are hereby incorporated by reference herein in their entirety.

TECHNICAL FIELD

The present invention relates to an image heating apparatus that can be used as a fixing device for fixing a formed toner image on a recording sheet in an image forming apparatus such as a printer or a copying machine employing an electrophotographic method.

BACKGROUND ART

Recently, a belt fixing type as illustrated in FIG. 11, for instance, is proposed as the fixing device utilizing the image heating apparatus that is used for the image forming apparatus of the electrophotographic type. This belt fixing type includes a heating roller 50, an endless belt 30 passed over the heating roller 50 and a separation roller 60 disposed separately from the heating roller 50 so as to rotate, and a pressure roller 70 for making the endless belt 30 pressure-contact the heating roller 50. In addition, the belt fixing type includes a cooling portion 80 for cooling a sheet retained by the endless belt 30 by contacting a belt inner circumferential surface of the endless belt 30 between the heating roller 50 and the separation roller 60. The heating roller 50 includes a roller core material 51, a heating halogen lamp 53 disposed inside the roller core material 51, and a coating layer 54 formed on the outer surface of the roller core material 51. Further, the pressure roller 70 includes a roller core material 71 and a coating layer 74 formed on the outer surface of the roller core material 71.

The endless belt 30 includes a belt substrate having a thickness of approximately 30 to 200 microns, and an elastic releasing layer having a thickness of approximately 10 to 200 microns formed on the outer circumferential surface of the belt substrate. The belt substrate is formed by using heat-resistant resin such as polyimide or polyamide and a metal material such as nickel or aluminum. In addition, the elastic releasing layer is formed by using silicone rubber, fluororubber or the like.

An operation of the fixing device having this structure is described.

The endless belt 30 is rotated in the direction indicated by the arrow "A" illustrated in FIG. 11, and a recording sheet P bearing a toner image T is fed to a pressure contact portion N between the endless belt 30 and the pressure roller 70. Then, the recording sheet P is retained on the surface of the endless belt 30 and passes through the cooling portion 80 so as to be cooled. The recording sheet P is further conveyed to the separation roller 60 and is separated from the endless belt 30. Those operations make the toner image T be fixed on the recording sheet P.

The cooling portion 80 cools the recording sheet P on which the toner image T is fixed at the pressure contact portion N1 via the endless belt 30, and hence the toner does not adhere to the endless belt 30 and an occurrence of offset can be prevented. In addition, since the recording sheet P is cooled after the toner image T is fixed on the recording sheet P in the state where the recording sheet P is retained on a flat belt surface, occurrence of a curl of the recording sheet P can be reduced. This technology is described in Japanese Patent Application Laid-Open No. 2004-203527. Note that the curl occurring in the recording sheet P at that time is mainly a curl in which the image side becomes concave due to the fixed toner that is shrunk more than the recording sheet when the recording sheet is cooled (hereinafter referred to as a toner curl).

Note that as the cooling portion there is one utilizing a cooling roller of an air cooling type that is disposed on the inner circumferential surface of the endless belt in a detachable manner, one utilizing an air cooling box having a lot of air passing holes formed on the surface contacting with the inner circumferential surface of the endless belt, or the like. Those technologies are described in Japanese Patent Application Laid-Open No. H04-216580 and Japanese Patent Application Laid-Open No. H05-72926.

Recently, however, various recording sheets having varieties of types, sizes and the like have become available in accordance with a purpose of use and the like of a user for the image forming apparatus such as a printer or a copying machine utilizing the electrophotographic method. For this reason, varieties of factors can affect a curl occurring in a recording sheet, and the factors include thickness of the recording sheet, density thereof, quality of material thereof, whether or not a coating layer is present, strength thereof, a grain direction thereof, contained moisture amount and the like.

In such the situation, it is difficult to prevent occurrence of the curl toward the image side of the recording sheet only by cooling and fixing the toner image in the cooling portion while the recording sheet is retained on the flat surface of the endless belt like the conventional fixing device.

In addition, recent printers and copying machines are required to have a higher productivity. When a conveying speed of the fixing belt is increased compared with the conventional one for instance, a cooling effect by the cooling portion may be decreased so that the effect of preventing occurrence of a curl may also be decreased.

Further, it can be considered to provide a curl correcting mechanism made up of a pair of rollers or the like on the downstream of the fixing device so that a generated curl can be corrected. When the curl correcting mechanism is used, however, the following problem may occur. When a curl correction is performed after the image side of the recording sheet is once separated from the endless belt, the image side may become coarse depending on surface smoothness of the curl correcting mechanism at a curl correction portion even when the image side has the same degree of smoothness as the endless belt due to the smoothness of the endless belt. In particular, when the recording sheet is not cooled sufficiently because of the increased conveying speed as described above, this problem may occur outstandingly.

Note that it may be considered to resolve the above-mentioned problem by adopting a curl correcting mechanism utilizing a belt having the same structure as the endless belt of the fixing device. However, the endless belt of the fixing device is usually expensive because the endless belt includes a belt substrate made of heat-resistant resin and a metal material such as nickel or aluminum, and an elastic releasing layer made of silicone rubber, fluororubber or the like formed on the belt substrate. Therefore, since cost of the apparatus may increase when the belt having the same structure as the endless belt is disposed for the curl correcting mechanism, the curl correcting mechanism usually utilizes a belt made of rubber or the like so that a high surface smoothness cannot be obtained.

DISCLOSURE OF THE INVENTION

The present invention has been made in view of the above-mentioned problem, and an object of the present invention is therefore to provide an image heating apparatus that is capable of preventing occurrence of a curl securely.

According to the present invention, an image heating apparatus includes: a rotatable belt to be heated; a pressure member for pressure-contacting the rotatable belt so as to constitute a pressure contact portion, wherein the pressure contact portion nips and conveys a recording sheet so that an image on the recording sheet is heated, and the recording sheet is conveyed while an image side of the recording sheet contacts the rotatable belt; and a pressing member provided for pressing the rotatable belt on a downstream in a sheet conveying direction of the pressure contact portion.

Further features of the present invention will become apparent from the following description of exemplary embodiments with reference to the attached drawings.

BEST MODE FOR CARRYING OUT THE INVENTION

Figure 4:
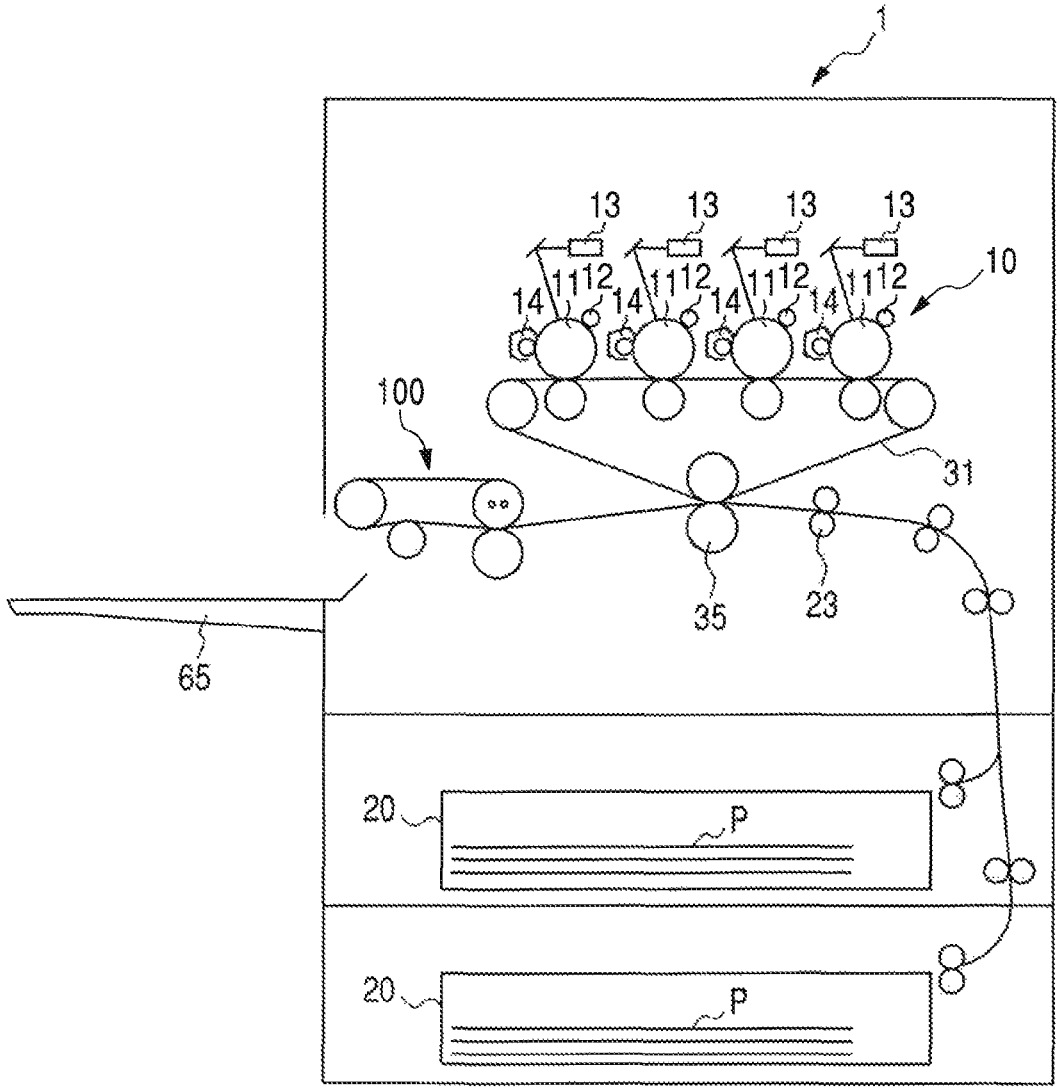
FIG. 4 is a cross-sectional view illustrating an example of an image forming apparatus according to the present invention.

An exemplary embodiment of the present invention is described. First, FIG. 4 is a cross-sectional view of a color electrophotographic printer (hereinafter referred to as a printer) 1 as an example of an image forming apparatus according to this embodiment. Note that as a recording sheet used in this embodiment, a sheet of plain paper, a resin recording sheet, a thick sheet, a sheet for an overhead projector or the like can be used.

The printer illustrated in FIG. 4 includes an image forming portion 10 made up of four-color image forming units for forming toner images of yellow (Y), magenta (M), cyan (C), and black (Bk) colors. The surface of a photosensitive drum 11 of each image forming unit is charged by a charging roller 12, and after that a latent image is formed by a laser scanner 13. The latent image is developed by a developing unit 14 so that a toner image is formed on the surface of the photosensitive drum 11. The toner image of the photosensitive drum 11 is transferred sequentially onto an intermediate transferring belt 31 as an image bearing member so that color images are superposed.

On the other hand, recording sheets P are housed in a paper feed cassette 20 disposed below the printer 1 and are sent out one by one from the paper feed cassette 20 to a registration roller pair 23. The registration roller pair 23 receives the recording sheet P temporarily so as to correct skew feeding. In addition, the registration roller pair 23 sends the recording sheet P to between the intermediate transferring belt 31 and a secondary transferring roller 35 in synchronization with the toner image formed on the intermediate transferring belt 31.

The color toner image including multiple colors superposed on the intermediate transferring belt 31 is transferred onto the recording sheet P by the secondary transferring roller 35. After that, the recording sheet P to which the toner image is transferred is sent to a fixing device 100 of the present invention, and the recording sheet P is heated and pressed by the fixing device 100 so that the toner image is fixed onto the recording sheet P. After that, the recording sheet P on which the toner image is fixed is delivered to a delivery tray 65 in the face up state (where the toner image is on the upper surface). Note that this embodiment illustrates the case where the image heating apparatus of the present invention is used as the fixing device for fixing a toner image onto a recording sheet.

First Embodiment

Figure 1:
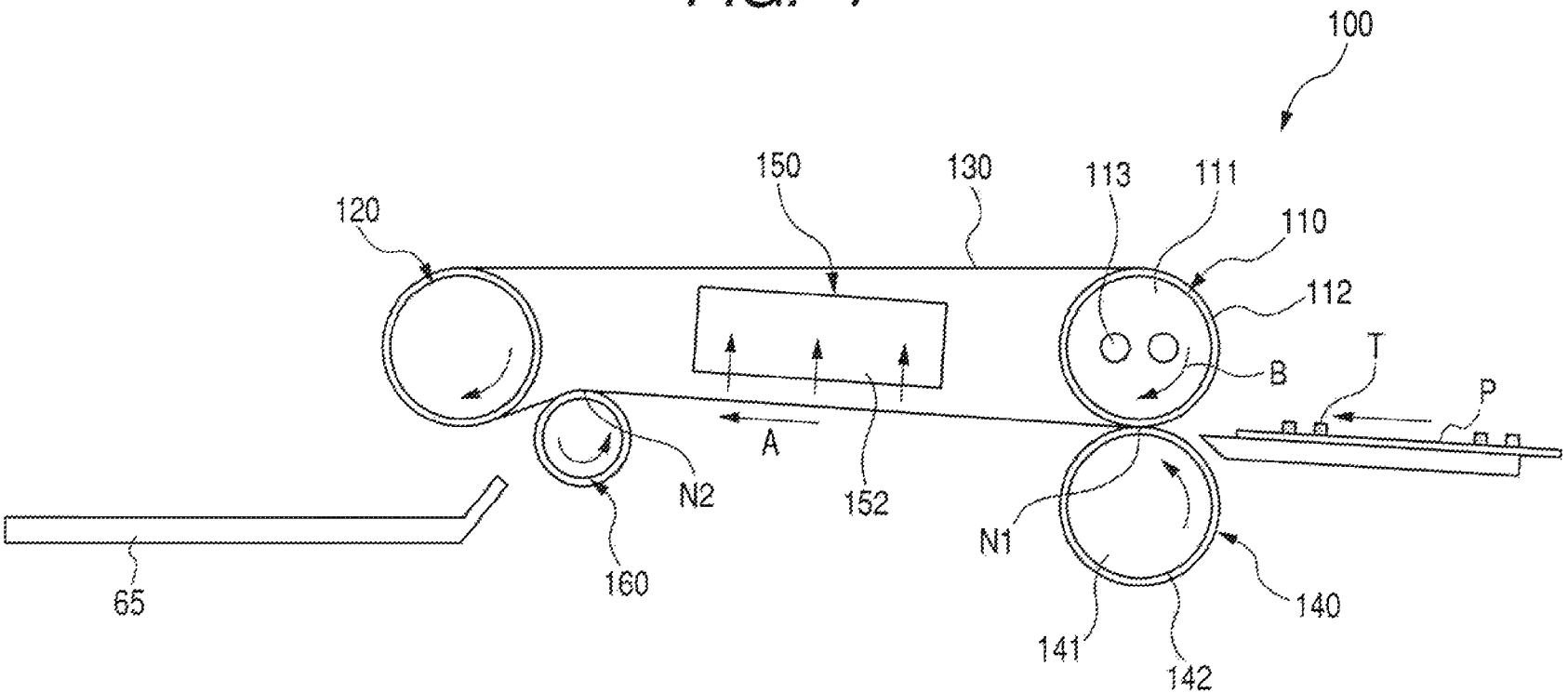
FIG. 1 is a cross-sectional view illustrating a fixing device according to a first embodiment of the present invention.
Figure 2:
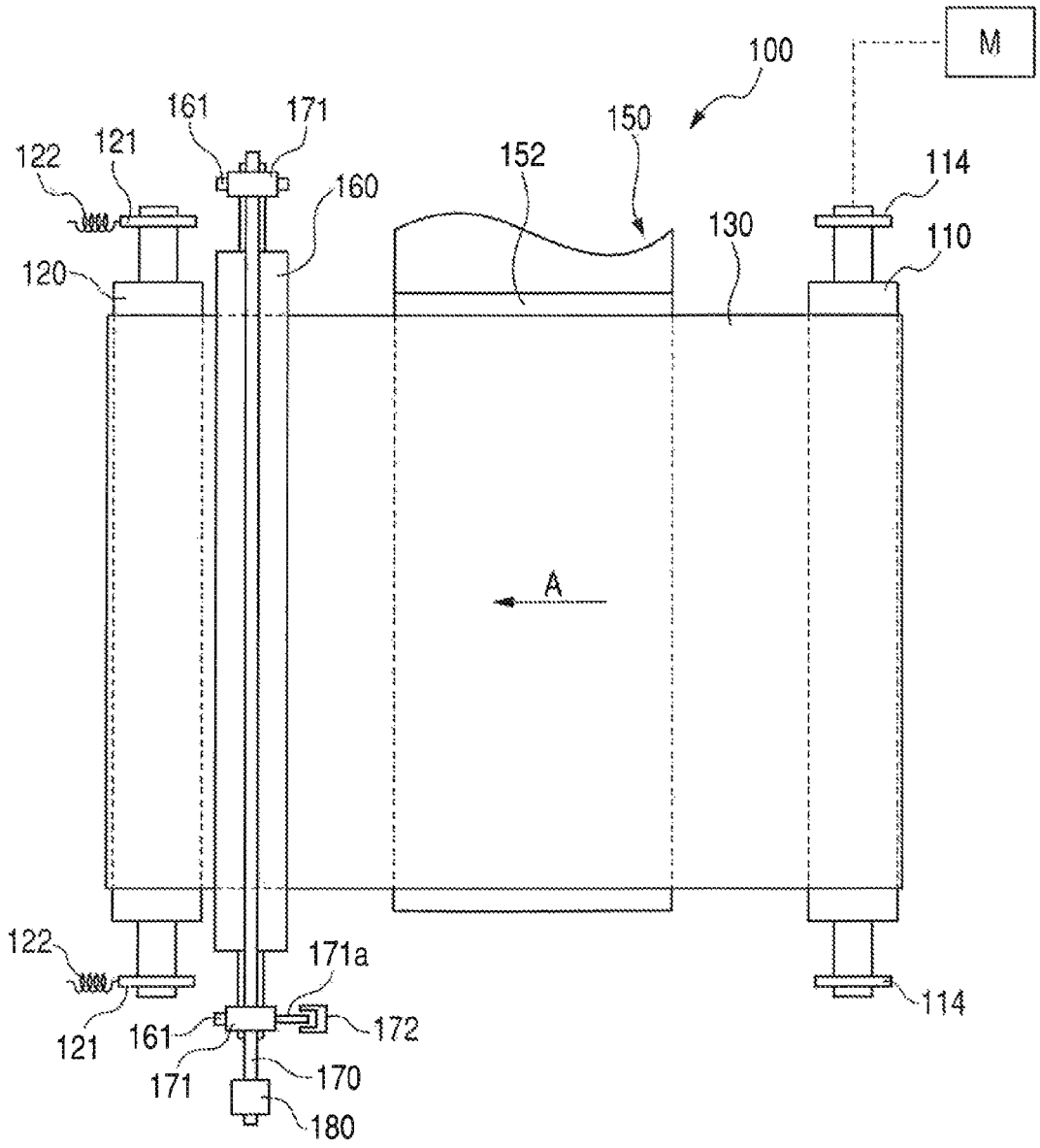
FIG. 2 is a bottom view of the fixing device illustrated in FIG. 1.

The fixing device 100 according to the first embodiment includes a heating roller 110, a separation roller 120, an endless belt 130, a pressure roller 140, a cooling portion 150, and a curl correction roller 160, which constitute a main part of the fixing device 100 as illustrated in FIGS. 1 and 2.

The heating roller 110 as a heating member of the present invention includes a roller main body including a cylindrical roller core material 111 made of aluminum, stainless steel or the like, a coating layer 112 formed on the roller core material 111, and a heating halogen lamp 113 disposed in the internal space of the roller core material 111. The coating layer 112 includes an elastic layer made of a silicone rubber or the like having a thickness of approximately 0.5 to 5 millimeters and a surface layer made of fluoroplastic (PFA or the like) having a thickness of approximately a few microns to a few tens of microns formed on the surface of the elastic layer, for instance.

As illustrated in FIG. 2, the heating roller 110 is supported by a support frame (not shown) via a bearing 114 in a rotatable manner and is driven to rotate in a predetermined direction (indicated by the arrow B as illustrated in FIG. 1) by a rotation drive unit including a motor M. In addition, a surface of this heating roller 110 is heated by a heating halogen lamp 113 of approximately 800 watts so as to be a fixing heat temperature (e.g., 150 to 180 degrees centigrade). In addition, the halogen lamp 113 is maintained to have a predetermined fixing heat temperature by feedback control based on detection information of a temperature sensor St (illustrated in FIG. 6) for measuring surface temperature of the heating roller.

The separation roller 120 as a separating member of the present invention is a roller for separating the recording sheet P retained and conveyed by the endless belt 130 from the endless belt 130, and the separation roller 120 is made of a metal material such as aluminum or stainless steel (SUS), for instance. This separation roller 120 is supported by a support frame (not shown) via a bearing 121 in a rotatable manner and is urged to exert a tension to the endless belt 130 by a tension exerting mechanism including a tension spring 122 and the like.

The endless belt 130 includes a belt substrate having a thickness of approximately 30 to 200 microns, and an elastic releasing layer having a thickness of approximately 10 to 200 microns formed on the outer circumferential surface of the belt substrate. The belt substrate is formed by using heat-resistant resin such as polyimide or polyamide and a metal material such as nickel or aluminum. In addition, the elastic releasing layer is formed by using silicone rubber, fluororubber or the like. The surface of the elastic releasing layer on the outer circumferential surface of the endless belt 130 can be as smooth as possible (close to a mirror-finished surface). This endless belt 130 is passed over the heating roller 110 and the separation roller 120 and is capable of rotating in the direction indicated by the arrow A illustrated in FIG. 1 by the rotation drive of the heating roller 110.

The pressure roller 140 is disposed so that the endless belt 130 can pressure-contact the heating roller 110, and the pressure roller 140 has the same layer structure as the heating roller 110, for instance. The pressure roller 140 includes a roller core material 141, and a coating layer 142. Note that a heating halogen lamp may be provided to the pressure roller 140 so as to add a heating function to the pressure roller 140 similarly to the heating roller 110, when necessary.

The pressure roller 140 as a pressure member of the present invention is supported by a support frame (not shown) in a rotatable manner, so as to pressure-contact the heating roller 110 by an elastic member such as a spring (not shown) at a predetermined pressure (50 to 200 kgf). In addition, a pressure contact portion (nip portion) N1 having a predetermined width in the conveying direction of the recording sheet is formed between the pressure roller 140 and the endless belt 130 due to the pressure-contact of the pressure roller 140.

The cooling portion 150 includes a cooling fan 151 (illustrated in FIG. 6) as an axial fan, and a duct 152 disposed on the inner side of the endless belt 130 between the heating roller 110 and the separation roller 120. Then, the cooling fan 151 sacks and exhausts air from the inner circumferential surface of the endless belt 130 through the duct 152 in the direction indicated by the arrows upward so that the endless belt 130 can be cooled from the inner side. This airflow cools and cures the toner image on the recording sheet P, and the smoothness of the surface of the endless belt 130 can smooth the surface of the toner image T that is transferred onto the recording sheet P. In addition, separate property of the recording sheet P from the endless belt 130 is improved.

Note that in this fixing device 100 the toner image T formed by the image forming portion 10 utilizing the electrophotographic method illustrated in FIG. 4 is transferred onto the recording sheet P, which is conveyed to the pressure contact portion N1 between the endless belt 130 and the pressure roller 140.

Figure 5A:
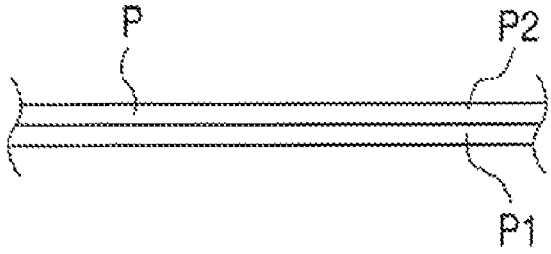
FIGS. 5A, 5B, and 5C are schematic diagrams illustrating a fixing process of a toner image on a recording sheet.
Figure 5B:
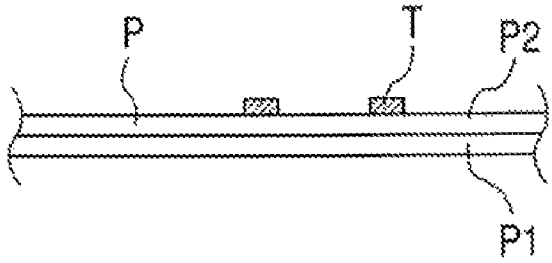
Figure 5C:
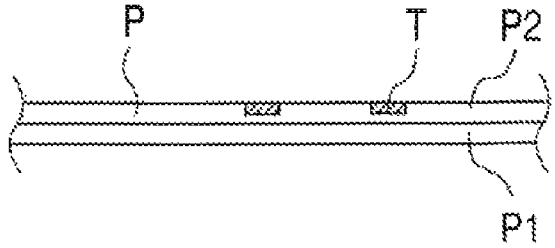

The recording sheet P on which the fixing process is performed by the fixing device 100 is not limited to a specific one as long as recording sheet P is a recording medium that can be used for the printer 1. However, when an image of photographic quality with good glossiness is desired to be obtained by the fixing device 100, a recording sheet having a transparent resin layer P2 made of thermoplastic resin as a main component that is formed and stacked on a substrate P1 can be used as exemplified in FIG. 5A. The substrate P1 can be plain paper for image formation, coated paper, photograph paper or the like. The thermoplastic resin forming the transparent resin layer P2 can be polyethylene resin, styrene-acrylic ester resin or the like. The transparent resin layer P2 can have a layer thickness such that the toner image T can be embedded in the transparent resin layer P2 when the transparent resin layer P2 is melted by the heat and pressure in the fixing process as illustrated in FIG. 5C after the toner image T is transferred as illustrated in FIG. 5B.

Figure 3:
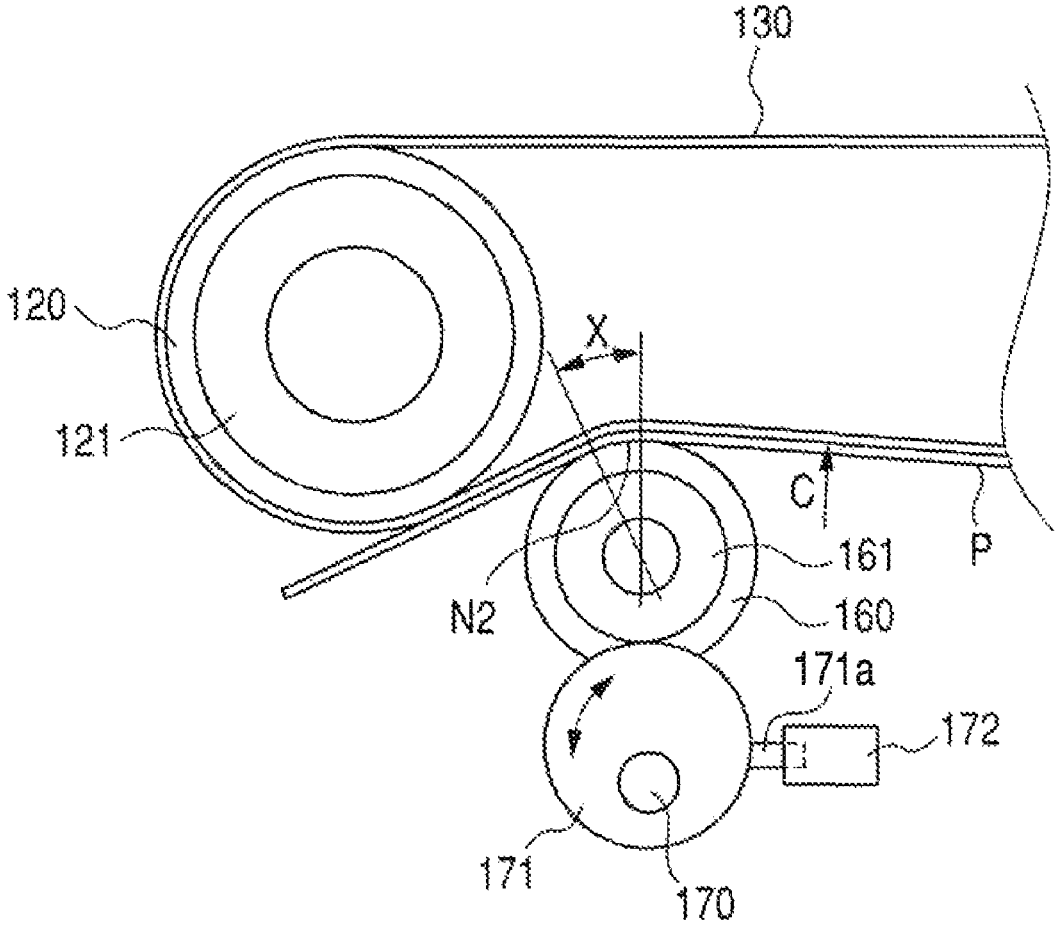
FIG. 3 is a cross-sectional view illustrating a detail of a curl correction roller portion of the fixing device illustrated in FIG. 1.

Next, with reference to FIGS. 2 and 3, a curl correcting mechanism of the present invention for correcting the curl (toner curl in particular) that may occur in the recording sheet is described. A pressing member as the curl correcting mechanism of the present invention is a curl correction roller 160 disposed on the downstream of the pressure contact portion (nip portion) N1 in the conveying direction of the sheet by the endless belt 130 (the direction indicated by the arrow A illustrated in FIG. 1) and between the cooling portion 150 and the separation roller 120. In addition, the curl correction roller 160 is provided so that the curl correcting mechanism can press the outer circumferential surface of the endless belt 130 supporting the recording sheet inward from the outside. Then, the curl correcting mechanism presses the endless belt 130 to make a concave shape that is concave inward, and the curl of the recording sheet can be corrected when the recording sheet passes through the concave pressed portion.

The curl correction roller 160 for pressing the outer circumferential surface of the endless belt 130 inward is a solid roller made of stainless steel for instance, and the curl correction roller 160 is supported by a support frame (not shown) via left and right bearings 161 in a rotatable manner so as to be driven to rotate when the endless belt 130 rotates. The bearings 161 are supported by the support frame in such a manner that the bearings 161 can reciprocate upward and downward (in the pressing direction of the curl correction roller 160), and the bearings 161 are supported from the lower side by drive cams 171 disposed on the left and the right sides. Note that a coating layer may be formed around the curl correction roller 160 similarly to the heating roller 110.

The two drive cams 171 are disposed to enable the contact angle X (illustrated in FIG. 3) of the endless belt 130 with respect to the curl correction roller 160 to be changed, and the two drive cams 171 are fixed to a cam shaft 170 so as to be driven to rotate when the cam shaft 170 rotates. The cam shaft 170 is connected to a stepping motor 180, which transmits a rotation drive force to the cam shaft 170 in accordance with an instruction from a control device 190 described later. A flag 171*a* for sensing a rotation position is formed integrally to one of the drive cams 171, and a reference rotation position of the drive cam is sensed when the flag 171*a* interrupts light to a photo interrupter 172.

Further, the drive cam 171 can be rotated to be a predetermined phase by rotation based on the number of steps of the stepping motor 180 from the reference rotation position. In this way, the rotation position control of the drive cam 171 is performed so that the contact angle X of the endless belt 130 with respect to the curl correction roller 160 can be set appropriately. Note that a phase of the drive cam 171 is set with respect to the reference rotation position where the drive cam 171 becomes the top dead center, i.e., the position where the curl correction roller 160 presses the endless belt 130 most as illustrated in FIG. 3 in this embodiment.

Figure 6:
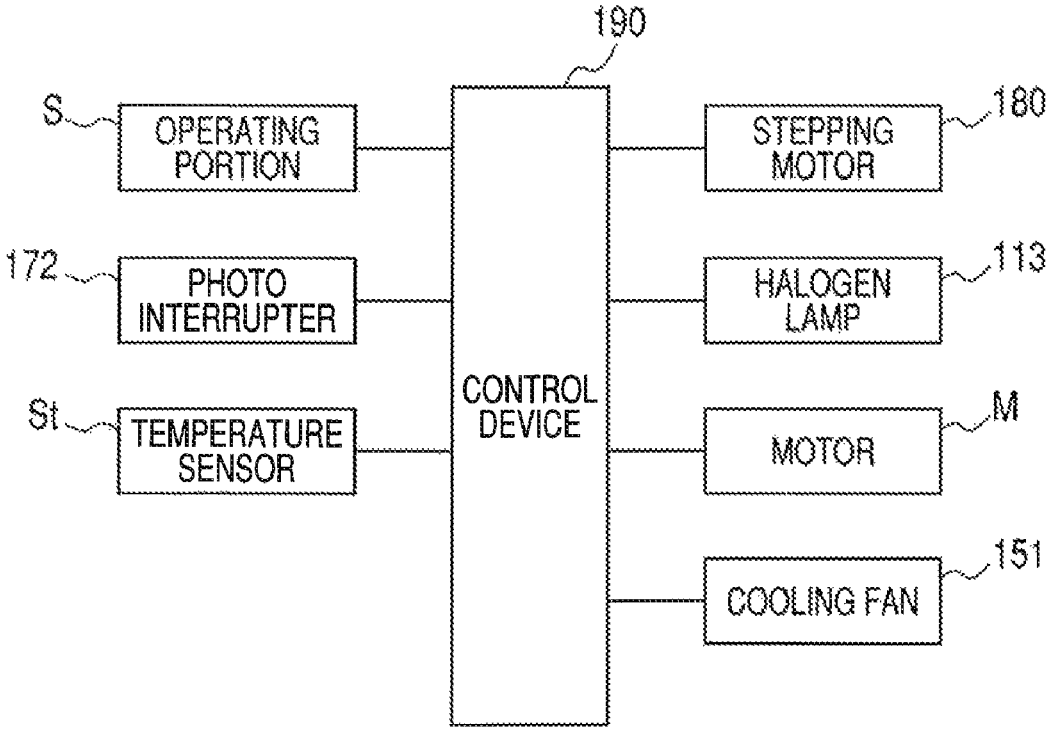
FIG. 6 is a control block diagram of a control portion provided in the first embodiment.
Figure 7:
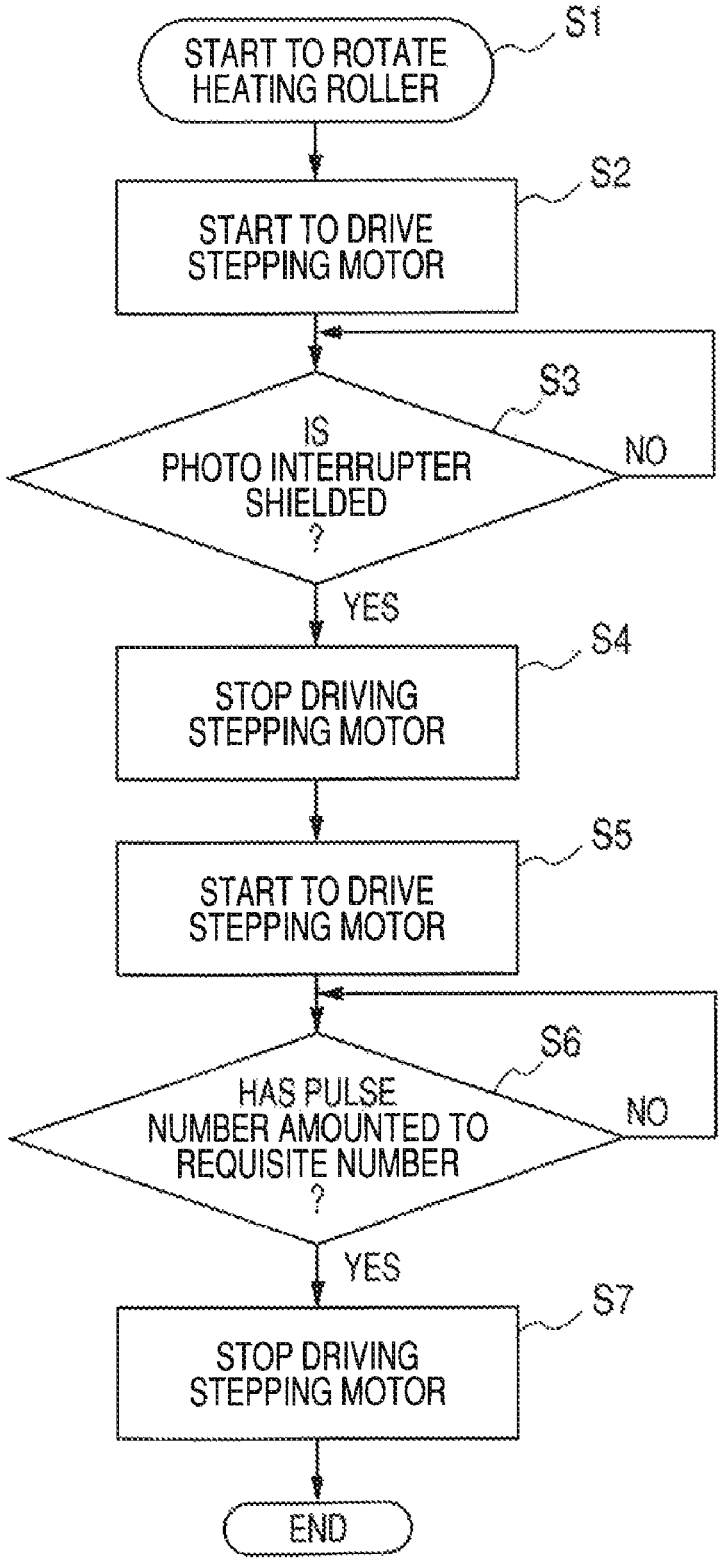
FIG. 7 is a flowchart illustrating a setting operation of the curl correction roller of the fixing device illustrated in FIG. 1.

Here, FIG. 6 is a control block diagram of the control portion for performing the setting operation for setting the curl correction roller 160 to be an appropriate position for the curl correction depending on the recording sheet, and FIG. 7 is a flowchart for describing the setting operation.

First, the control block diagram illustrated in FIG. 6 is described.

The control device 190 is supplied with information designating a type and a thickness of the recording sheet P, which is input by a user from a printer 1 or an operation portion S such as a personal computer connected to the printer 1. In addition, the control device 190 is supplied with a detection signal for detecting a reference rotation position of the drive cam 171 from the photo interrupter 172, as well as a detection signal from the temperature sensor St for measuring surface temperature of the heating roller 110. Then, the control device 190 controls rotation of the stepping motor 180 based on the detection signal from the photo interrupter 172 so as to perform the rotation position control of the drive cam 171, and hence the curl correction roller 160 moves to an optimal position in accordance with information of the recording sheet. In addition, the control device 190 controls temperature of the heating halogen lamp 113 based on the detection signal of the temperature sensor St so as to maintain an appropriate fixing heat temperature.

Note that the control device 190 performs controls of general operation of the fixing device 100 including a control of the motor M for driving the heating roller 110 of the fixing device 100, a control of the cooling fan 151 of the cooling portion 150, and the like.

Next, operations of this fixing device 100 are described. First, an operation of setting a position of the curl correction roller 160 is described with reference to the flowchart illustrated in FIG. 7.

When the fixing operation is started, the heating roller 110 starts the rotation drive such that the endless belt 130 is rotated in the direction indicated by the arrow B, and the heating halogen lamp 113 is activated to heat the heating roller 110 up to the predetermined fixing temperature. On this occasion, the pressure roller 140 is driven to rotate through the endless belt 130 in accordance with the rotation of the heating roller 110 (STEP1).

The drive cam 171 starts to rotate by the rotation drive of the stepping motor 180. The drive cam 171 rotates until the top dead center as illustrated in FIG. 3 and then stops when the photo interrupter 172 detects the position as the reference rotation position. In this state the curl correction roller 160 presses the outer circumferential surface of the endless belt 130 inward from the lower side with a maximum amount so as to form a conveying path that has a concave shape.

At this time, the curl correction roller 160 drives the drive cam 171 to rotate until the position corresponding to the curl correction of the recording sheet P based on the information designating a type and a thickness of the recording sheet P input by the user from the operation portion S. Thus, the contact angle X of the endless belt 130 with respect to the curl correction roller 160 can be set appropriately, and hence an optimal curl correction can be performed on the recording sheet that passes through the pressed portion of the curved conveying path.

This operation is described with reference to the flowchart. The drive cam 171 starts to rotate by the rotation drive of the stepping motor 180 (STEP2). Next, when light to the photo interrupter 172 is interrupted by the flag 171*a* (STEP3), the drive cam 171 rotates to be the top dead center so that the stepping motor 180 is stopped as being decided that the drive cam 171 has moved to the reference rotation position (STEP4). After that, the stepping motor 180 is driven to rotate by the number of drive pulses corresponding to an optimal inroad amount with respect to the endless belt 130 of the curl correction roller 160 for the type and the thickness of the recording sheet P (STEP5). Then, reaching the necessary number of pulses (STEP6), the stepping motor 180 is stopped (STEP7).

The optimal inroad amount with respect to the endless belt 130 of the curl correction roller 160 for the type and the thickness of the recording sheet P means, for instance, the position where the drive cam 171 is rotated to the top dead center in the case of recycled paper of A3 size and a basis weight of 52 grams, which needs a largest curl correction effect. In this case, the inroad amount of the curl correction roller 160 with respect to the endless belt 130 is required to be approximately 20 mm. With respect to this position, high quality paper of the basis weight of 52 grams needs 15 mm, plain paper of the basis weight of 80 grams needs 7 mm, and coated thick paper of the basis weight of 250 grams needs 18 mm. The control device 190 instructs rotation drive pulses of the stepping motor 180 corresponding to the inroad amount. In this way, the curl correcting mechanism is set to be an appropriate state.

Next, operations of the fixing device 100 after the curl correction roller 160 is set to be an appropriate position are described.

The recording sheet P to which the toner image T is transferred after being formed in the image forming portion 10 of the printer 1 in accordance with image information is sent to the fixing device 100, i.e., to the pressure contact portion N1 between the fixing belt 130 and the pressure roller 140 by a paper transport device (not shown). Thus, the toner image T on the recording sheet P is heated and pressed in the pressure contact portion N1 so as to be melted and embedded inside the recording sheet P (the transparent resin layer P2 thereof). Then, the recording sheet P is nipped and conveyed by the pressure contact portion N1 and then is conveyed while contacting (closely contacting) the outer circumferential surface of the endless belt 130 when the belt 130 rotates.

Next, the recording sheet P to be fixed that is conveyed while contacting the endless belt 130 is conveyed to pass through a belt portion (cooling region) where the air is sucked by the cooling portion 150 while maintaining its contacting state with the endless belt 130, and hence the recording sheet P is cooled forcibly by the cooling portion 150 when the recording sheet P passes through the cooling region. In other words, the recording sheet P and the toner image T heated in the pressure contact portion N1 are cooled as heat thereof is transmitted to the cooling portion 150 via the endless belt 130 while the recording sheet P passes through the cooling region. The air sucked toward the cooling portion 150 passes through a duct (not shown) and is discharged to the outside of the printer 1.

The toner image T is embedded in the recording sheet P (the transparent resin layer P2 thereof) in the pressure contact portion N1, and then the toner image T and the recording sheet P (the transparent resin layer P2 thereof) are cooled in the cooling portion 150 so that the toner image T is cured.

Then, the recording sheet P that has passed through the cooling region of the cooling portion 150 is given a bending force to be convex upward in FIG. 3 when the recording sheet P passes through the pressure contact portion (nip portion) N2 formed by the endless belt 130 and the curl correction roller 160 while contacting the endless belt 130. Therefore, the toner curl (the curl of a convex shape downward) due to shrinkage of the toner image T when the toner image T is cooled and cured is corrected in the state where the recording sheet P (the transparent resin layer P2 thereof) closely contacts the surface of the endless belt 130.

In addition, the recording sheet P is given a bending force to be convex upward in FIG. 3 when the recording sheet P passes through the pressure contact portion N2 formed by the endless belt 130 and the curl correction roller 160. On this occasion, a portion placed behind the pressure contact portion N2 formed by the endless belt 130 and the curl correction roller 160 is pressed in the direction indicated by the arrow C of FIG. 3, i.e., toward the endless belt 130 in accordance with rigidity (stiffness) of the recording sheet P. Thus, close contact property of the recording sheet P with the endless belt 130 is improved.

The recording sheet P that has passed through the pressure contact portion N2 is conveyed to the separation roller 120 while contacting the endless belt 130 as illustrated in FIG. 3. Then, the rigidity (stiffness) of the portion of the endless belt 30 having a curvature at the separation roller 120 and the recording sheet P itself contradict with each other so that the recording sheet P is separated naturally from the endless belt portion at the separation roller 120. Thus, the fixing process of the recording sheet P is finished, and the recording sheet P is stacked in the delivery tray 65.

When the fixing operation conducted by the fixing device 100 is performed normally, the toner image T is fixed while being uniformly embedded in the recording sheet P (the transparent resin layer P2 thereof). Further, the fixing process is performed in such a manner that the surface of the recording sheet (the surface of the transparent resin layer P2) after the fixing process becomes a state of excellent smoothness following the smooth surface of the endless belt 130. The image on the recording sheet P after this fixing process can be obtained as a high quality image similar to a photograph image with little diffuse reflection of light due to the concavity and convexity of the surface and with a good glossiness.

In addition, also in the case where ordinary plain paper without the transparent resin layer P2 is used as the recording sheet P, the fixing process is performed in such a state where the toner image T is embedded uniformly in fibers of the recording sheet P. In addition, the fixing process is performed in such a manner that the surface of the recording sheet P and the surface of the toner image after the fixing process becomes a state of excellent smoothness following the smooth surface of the endless belt 130. Thus, the image on the recording sheet P after this fixing process can be obtained as a high quality image similar to a photograph image with little diffuse reflection of light due to the concavity and convexity of the surface and with a good glossiness.

(Variations)

Figure 8:
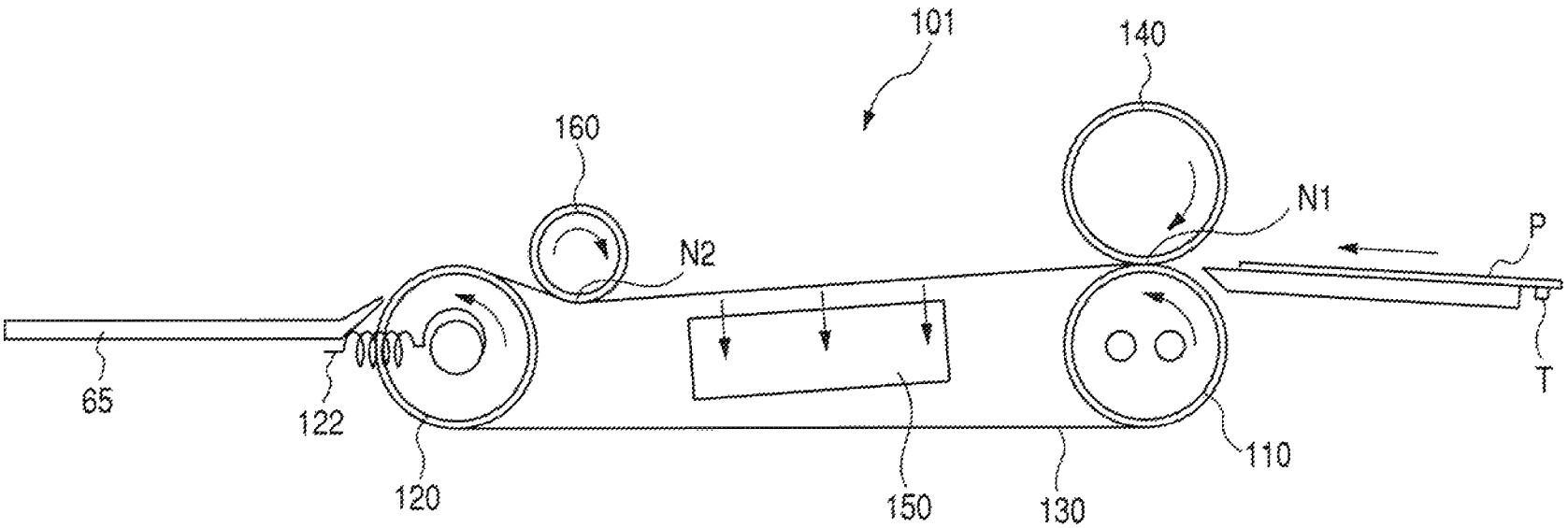
FIG. 8 is a cross-sectional view of the fixing device having a structure inverse to that of the fixing device illustrated in FIG. 1.

As illustrated in FIG. 8, the fixing device may have a structure in which the positional relationship between the endless belt 130 and the pressure roller 140 is a vertically inverse relationship. Main portions of this fixing device 101 include a heating roller 110, a separation roller 120, an endless belt 130, a pressure roller 140, a cooling portion 150 and a curl correction roller 160, similarly to the fixing device 100 described above, and they are disposed inversely to the fixing device 100.

Note that the fixing device 101 is different from the fixing device 100 only in the vertical positional relationship, and that structures and operations of the individual main portions are the same so that descriptions thereof are omitted.

In the fixing device 101 having this structure, a force of close contact between the endless belt 130 and the recording sheet P is increased because a weight of the recording sheet P is added to the force, so the curl correction can be performed more effectively.

According to the structures described above, varieties of curls (toner curl in particular) of recording sheets can be corrected effectively in the state where the recording sheet P contacts closely the surface of the endless belt 130. For this reason, the image on the recording sheet P after this fixing process can be obtained as a high quality image similar to a photograph image with little diffuse reflection of light due to the concavity and convexity of the surface and with a good glossiness. In addition, the output paper with high quality from which a curl is removed can be obtained.

In addition, since the curl correction roller 160 is used for removing the curl unlike the conventional apparatus relying on only the cooling effect of the cooling portion 150, high productively can be achieved without lowering the conveying speed of the endless belt 130.

Second Embodiment

A fixing device 200 using the image heating apparatus according to a second embodiment of the present invention is described with reference to FIGS. 9 and 10. Note that the portions having the same structures as the fixing device 100 of the first embodiment are denoted by the same reference symbols so that descriptions thereof are omitted. In addition, the curl correcting mechanism is different while the basic fixing operation is the same as the fixing device 100 so that description thereof is omitted.

A tension roller 210 as a second pressing member of the present invention is disposed in such a manner that the upstream of the curl correction roller 160 provided to the fixing device 200 presses the endless belt 130 from the inner circumferential surface of the endless belt 130. This tension roller 210 is provided for making the contact angle X of the endless belt 130 with respect to the curl correction roller 160 be larger than that in the case of the first embodiment, to thereby increase a period of time for giving the recording sheet P the bending force to be convex upward. In other words, the tension roller 210 enables a force for correcting a curl exerted on the recording sheet P to increase.

The tension roller 210 is supported by a support frame (not shown) via a bearing 211 in a rotatable manner, and disposed so as to press the inner circumferential surface of the endless belt 130 outward from the inner side of the endless belt 130. Then, this structure enables the tension roller 210 to be driven to rotate by the rotation of the endless belt 130.

The recording sheet P is applied with a bending force to be convex upward that is larger than that in the case of the first embodiment when the recording sheet P passes through the pressure contact portion N2 formed by the endless belt 130 and the curl correction roller 160. Therefore, the curl correction can be performed efficiently even in a recording sheet in which a large curl may occur.

Figure 9:
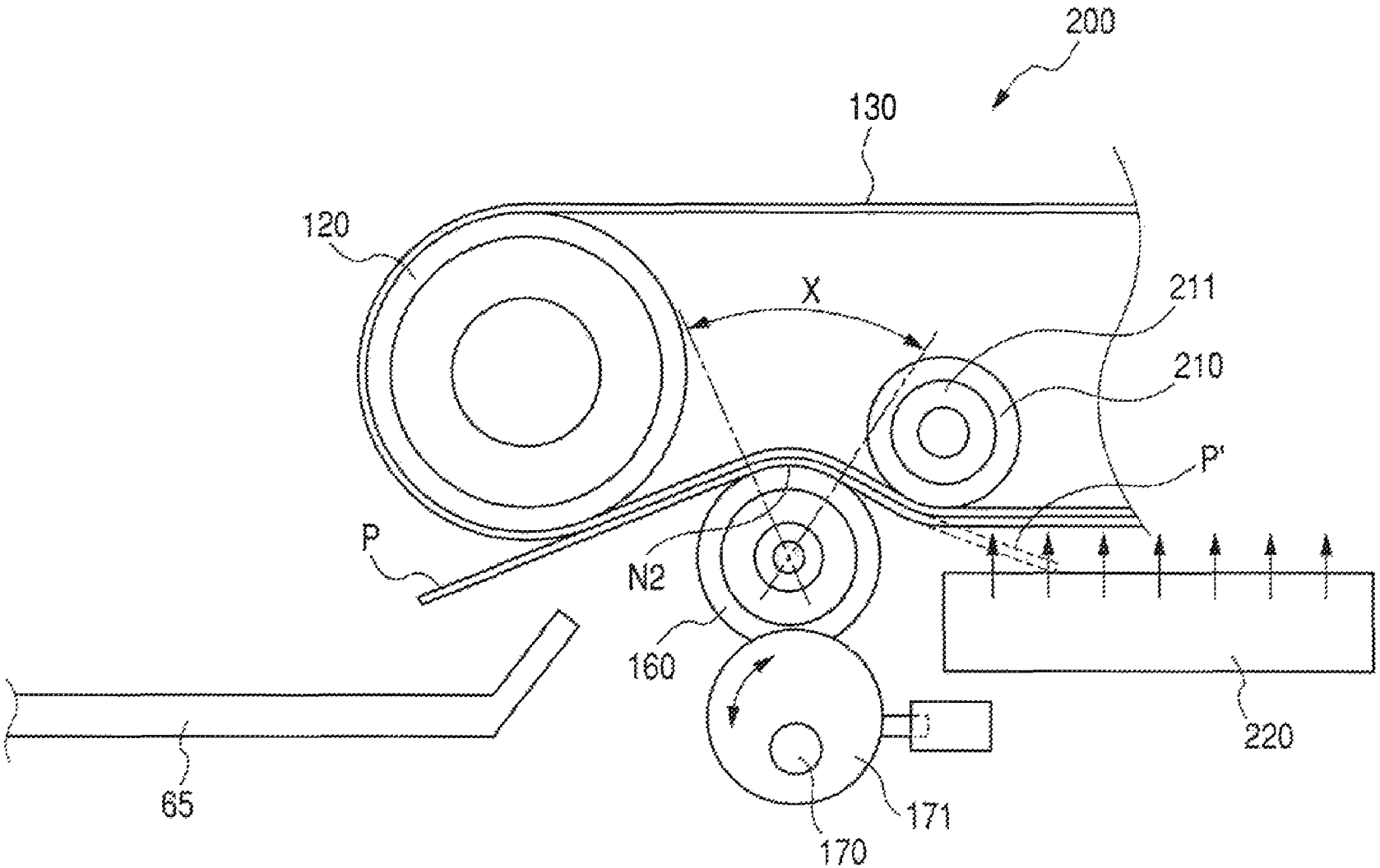
FIG. 9 is a cross-sectional view illustrating details of the curl correction roller portion of a fixing device according to a second embodiment of the present invention.
Figure 10:
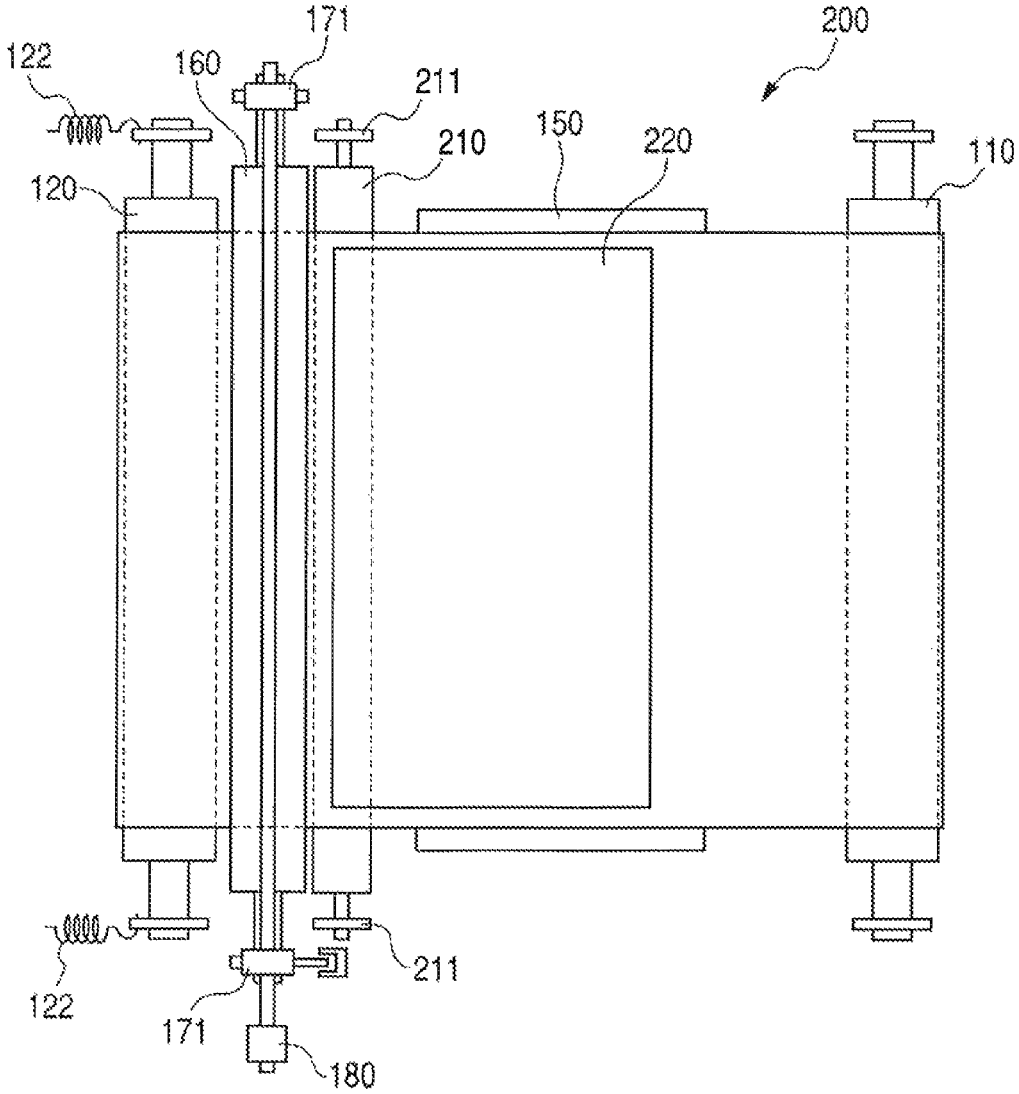
FIG. 10 is a bottom view of the fixing device illustrated in FIG. 9.
Figure 11:
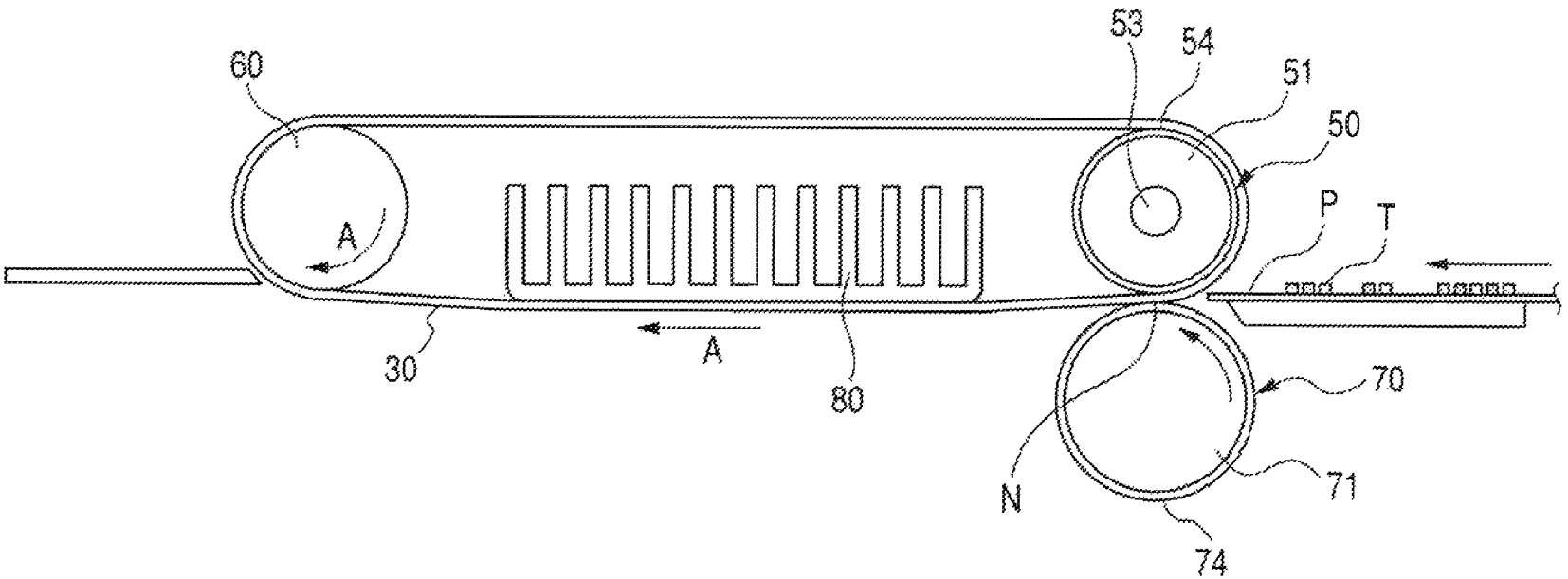
FIG. 11 is a cross-sectional view illustrating an example of a conventional fixing device.

Note that a portion placed behind the portion where the endless belt 130 area-contacts the tension roller 210 is apt to separate from the surface of the endless belt 130 as illustrated in FIG. 9 by a broken line P' in accordance with rigidity (stiffness) of the recording sheet P when the curl is corrected. Therefore, a fan 220 as a blowing means of the present invention is disposed corresponding to a location of the tension roller 210 on the upstream of the curl correction roller 160, and hence blowing air from the fan 220 can force the recording sheet P to be pressed toward the surface of the endless belt 130. Thus, separation of the sheet from the surface of the endless belt 130 can be prevented while the contact can be maintained so that disturbance or the like of the image can be prevented.

In this embodiment, the contact angle X of the endless belt 130 with respect to the curl correction roller 160 can be larger than that in the case of the first embodiment only by adding the fan 220 and the tension roller 210. Thus, when the recording sheet P passes through the pressure contact portion N2 formed by the endless belt 130 and the curl correction roller 160, a bending force to make the recording sheet P be convex upward is added that is larger than that in the case of the first embodiment so that the curl correction can be performed more efficiently.

In addition, since the fan 220 blows air, which presses the recording sheet P to the endless belt 130 so that the recording sheet P is not separated. In addition, the air from the fan 220 can also be used for cooling the recording sheet, and hence image quality can be improved.

Although embodiments of the present invention are described above, the present invention is not limited to the embodiments. For instance, although the embodiment described above exemplifies the case where the image heating apparatus of the present invention is applied to the fixing device for fixing the toner image on the recording sheet, the present invention is not limited thereto. For instance, the toner image may be fixed on the recording sheet by a general fixing device for fixing a toner image, and then the recording sheet may pass through the image heating apparatus according to the present invention, and hence an image with higher glossiness can be obtained. In other words, when the toner image fixed by the fixing device is reheated by the image heating apparatus of the present invention, the toner image can be fixed in such a manner that the toner image is embedded uniformly in the recording sheet (the transparent resin layer thereof) more reliably. Further, the fixing device enables the surface of the recording sheet (the surface of the transparent resin layer) after the fixing process to become a state of excellent smoothness following the smooth surface of the endless belt of the image heating apparatus. Thus, a recording sheet on which a high quality image similar to a photograph image is formed can be obtained.

Note that it is possible to design such an image heating apparatus as a unit that is separate from the image forming apparatus so as to be detachably mountable to the image forming apparatus, and hence the image heating apparatus can be mounted to the image forming apparatus for use as necessity. In addition, it is possible to adopt the structure for selecting an image with normal glossiness that is obtained by passing through the fixing device or an image with high glossiness that is obtained by passing through both the fixing device and the image heating apparatus, in accordance with a using purpose of a user.

Further, although this example describes the structure where the outer circumferential surface of the endless belt 130 is pressed inward for correcting the curl, it is possible to press the inner circumferential surface of the endless belt 130 outward for correcting the curl depending on an orientation of the formed curl. In this case, it is necessary to make the outer side of the endless belt 130 contact a sponge roller, a belt or the like so that the pressure contact portion N2 is constituted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-270084, filed Oct. 17, 2007, which is hereby incorporated by reference herein in its entirety.

The invention claimed is:

1. An image heating apparatus, comprising:

a rotatable belt to be heated;

a pressure member for pressure-contacting the rotatable belt so as to constitute a pressure contact portion, wherein the pressure contact portion nips and conveys a recording sheet so that an image on the recording sheet is heated, and the recording sheet is conveyed while an image side of the recording sheet contacts the rotatable belt;

a cooling portion provided downstream of the pressure member configured to cool the recording sheet heated by the pressure member;

a pressing member provided downstream of the cooling portion in a sheet conveying direction for pressing an outer circumferential surface of the rotatable belt inward, wherein the pressing member is supported to be able to reciprocate in a pressing direction of the pressing member; and a drive cam disposed to enable the pressing member to change a position in the pressing direction for pressing the rotatable belt so that a contact angle with respect to the rotatable belt can be changed.

2. An image heating apparatus according to claim 1, wherein the rotatable belt is passed over a heating member for heating the rotatable belt and a separating member for separating the recording sheet from the rotatable belt, the pressure member is urged toward the heating member so as to constitute the pressure contact portion between the pressure member and the rotatable belt, and the rotatable belt is pressed by the pressing member between the pressure contact portion and the separating member so as to area-contact the pressing member.

3. An image heating apparatus according to claim 1, further comprises a second pressing member upstream of the pressing member for pressing an inner circumferential surface of the rotatable belt outward.

4. An image heating apparatus according to claim 3, further comprising blowing means for blowing air toward the outer circumferential surface of the rotatable belt so as to maintain a contact of the recording sheet with the rotatable belt at a position where the second pressing member is disposed.

5. An image forming apparatus, comprising:

a transfer device for transferring a toner image onto a recording sheet; and an image heating apparatus as recited in claim 1 for heating and fixing the toner image transferred by the transfer device.

6. An image forming apparatus, comprising:

a transfer device for transferring a toner image onto a recording sheet;

a fixing device for fixing the toner image transferred by the transfer device; and an image heating apparatus as recited in claim 1 for heating the toner image fixed on the recording sheet by the fixing device.

7. An image forming apparatus according to claim 6, wherein the image heating apparatus is detachably mountable to the image forming apparatus.

8. An image heating apparatus, comprising:

a rotatable belt to be heated;

a pressure member for pressure-contacting the rotatable belt so as to constitute a pressure contact portion, wherein the pressure contact portion nips and conveys a recording sheet so that an image on the recording sheet is heated, and the recording sheet is conveyed while an image side of the recording sheet contacts the rotatable belt;

a cooling portion provided downstream of the pressure member configured to cool the recording sheet heated by the pressure member; and a pressing member provided downstream of the cooling portion in a sheet conveying direction for pressing an outer circumferential surface of the rotatable belt inward, wherein the pressing member is supported to be able to reciprocate in a pressing direction of the pressing member; and a second pressing member upstream of the pressing member for pressing an inner circumferential surface of the rotatable belt outward.

9. An image heating apparatus according to claim 8, wherein the rotatable belt is passed over a heating member for heating the rotatable belt and a separating member for separating the recording sheet from the rotatable belt, the pressure member is urged toward the heating member so as to constitute the pressure contact portion between the pressure member and the rotatable belt, and the rotatable belt is pressed by the pressing member between the pressure contact portion and the separating member so as to area-contact the pressing member.

10. An image heating apparatus according to claim 9, further comprising blowing means for blowing air toward the outer circumferential surface of the rotatable belt so as to maintain a contact of the recording sheet with the rotatable belt at a position where the second pressing member is disposed.

11. An image forming apparatus, comprising:

a transfer device for transferring a toner image onto a recording sheet; and an image heating apparatus as recited in claim 8 for heating and fixing the toner image transferred by the transfer device.

12. An image forming apparatus, comprising:

a transfer device for transferring a toner image onto a recording sheet;

a fixing device for fixing the toner image transferred by the transfer device; and an image heating apparatus as recited in claim 8 for heating the toner image fixed on the recording sheet by the fixing device.

* * * * *